US007100878B2

(12) United States Patent
Shea

(10) Patent No.: US 7,100,878 B2
(45) Date of Patent: Sep. 5, 2006

(54) AISLE WAY END EXTENDER BRACKET FOR USE WITH A VERTICALLY EXTENDING MERCHANDISING SUPPORT SURFACE

(76) Inventor: Thomas M. Shea, 984 Livernois, Troy, MI (US) 48083

( * ) Notice: Subject to any disclaimer, the term of this patent is extended or adjusted under 35 U.S.C. 154(b) by 521 days.

(21) Appl. No.: 10/090,719

(22) Filed: Mar. 4, 2002

(65) Prior Publication Data

US 2003/0164432 A1 Sep. 4, 2003

(51) Int. Cl.
*A47B 96/06* (2006.01)

(52) U.S. Cl. ..... 248/220.31; 211/90.02

(58) Field of Classification Search ..... 248/220.31, 248/220.42, 220.43, 240, 241, 288.11; 211/87.01, 211/103, 105.1, 90.02, 90.01, 186, 144, 135, 211/149; 52/36.4, 36.5, 36.6
See application file for complete search history.

(56) References Cited

U.S. PATENT DOCUMENTS

| | | | | | |
|---|---|---|---|---|---|
| 3,250,235 | A | * | 5/1966 | McDonnell | 108/152 |
| 4,179,091 | A | * | 12/1979 | Bidney | 248/265 |
| 4,362,249 | A | * | 12/1982 | Thalenfeld | 211/59.1 |
| 4,449,686 | A | | 5/1984 | Kersey | 248/215 |
| 4,854,533 | A | * | 8/1989 | Sainato | 248/220.42 |
| 4,874,148 | A | | 10/1989 | Guinter | 248/225.2 |
| 5,152,404 | A | | 10/1992 | Salrin et al. | 211/46 |
| D335,623 | S | | 5/1993 | Salrin et al. | D8/373 |
| 5,346,166 | A | * | 9/1994 | Valiulis | 248/220.41 |
| 5,443,167 | A | | 8/1995 | Menaged et al. | 211/87 |
| 5,657,884 | A | * | 8/1997 | Zilincar, III | 211/86.01 |
| 5,660,286 | A | | 8/1997 | Shea | 211/87.01 |
| 5,913,499 | A | * | 6/1999 | Kiggins | 248/200 |
| 5,924,663 | A | | 7/1999 | Gatto | 248/231.71 |
| 5,947,431 | A | | 9/1999 | Kiggins | 248/200 |
| 5,957,422 | A | | 9/1999 | Shea | 248/220.31 |
| 6,006,929 | A | * | 12/1999 | Leonard | 211/113 |
| D422,483 | S | | 4/2000 | Shea | D8/354 |
| D422,886 | S | | 4/2000 | Shea | D8/354 |
| 6,070,747 | A | * | 6/2000 | Shea | 211/87.01 |
| D435,435 | S | | 12/2000 | Shea | D8/363 |
| 6,199,706 | B1 | | 3/2001 | Shea | 211/87.01 |
| 6,202,866 | B1 | * | 3/2001 | Shea | 211/87.01 |
| 6,220,461 | B1 | | 4/2001 | Dickinson | 211/90.01 |
| 6,234,330 | B1 | * | 5/2001 | Gray | 211/106 |
| 6,273,385 | B1 | * | 8/2001 | Hambleton | 248/304 |
| 6,349,909 | B1 | * | 2/2002 | Zarrow et al. | 248/220.41 |
| 6,612,057 | B1 | * | 9/2003 | Shoemaker et al. | 40/607.02 |

* cited by examiner

*Primary Examiner*—A. Joseph Wujciak, III
(74) *Attorney, Agent, or Firm*—Gifford, Krass, Groh, Sprinkle, Anderson, & Citowski, P.C.

(57) ABSTRACT

An aisle way end extender bracket for use with an upright merchandising display, the display including a lengthwise extending wall and terminating in a vertically extending end cap support. The bracket includes an elongate extending support arm having a first support end and a second extended and product display end. A foot support is secured to the first support end and engages with a location of the upright merchandising display proximate its vertically extending end, the foot support further including a planar support surface capable of affixing, in substantially adhering fashion, against a corresponding planar extending portion of the merchandising display. The product display end further includes an "S" shook suspended through an aperture defined within the support arm. A product support portion suspends from the "S", typically in freely swinging fashion, and holds a plurality of individual merchandising items in substantially coplanar, parallel extending and displayed fashion beyond the vertically extending end cap of the lengthwise extending wall.

5 Claims, 7 Drawing Sheets

AISLE WAY END EXTENDER BRACKET FOR USE WITH A VERTICALLY EXTENDING MERCHANDISING SUPPORT SURFACE

BACKGROUND OF THE INVENTION

1. Field of the Invention

The present invention relates generally to merchandise support bracketry, such as for use with existing upright gondola or merchandising support structures. More particularly, the present invention discloses an aisle way end extender bracket for use with such a vertically extending merchandising support and which extends in parallel fashion from an extending aisle end of the upright support back wall.

2. Description of the Prior Art

Typical merchandise display assemblies include the provision of upright gondola supports. Such gondola assemblies further typically include an elongate, lengthwise extending back wall and from which extend, in opposite and multi-tiered fashion, pluralities of shelving portions upon which the merchandised goods are supported and displayed.

As is further known, the amount of merchandising shelf space provided by an existing gondola display unit is limited to the supporting and carrying capacity of its various tiers. Accordingly, attempts have been made to increase the effective carrying space of the gondola display through the provision of merchandise carrying and display structures. These support structures are typically attachable to either on or more gondola shelves or, alternatively, to the elongate extending back wall of the existing gondola display (such facing outwardly into the aisle space defined adjacent to the extending gondola display). Prior art examples of such merchandising displays include such as those taught by U.S. Pat. No. 5,443,167, issued to Menaged et al., and U.S. Pat. No. 5,660,286, issued to Shea, and are each capable of carrying additional quantities of typically smaller sized merchandise.

Additional attempts have been made to exploit the extending ends of the gondola displays in order to further increase the product carrying capability. However it has been found that such merchandise extension displays as taught by Menaged and Shea are not well suited for use with the end (or side) extending edges of the gondola displays, typically in view of the extent in which the merchandising display extends into airspace reserved for customer traffic.

Along the above lines, end cap merchandising assemblies (these being shelf-like and upwardly extending displays) have likewise been found to sufficiently cut into available end aisle traffic space such that they are often impractical to employ. Additionally, it has been found that the relatively narrow side profile of the existing gondola display, such as provided by the gondola's upwardly extending back wall, is not well suited for accommodating such separate end cap displays.

Additional examples of prior art display bracketry include U.S. Pat. No. 4,874,148, issued to Guinter, which teaches a bracket releasably secured to existing display uprights. In use, two brackets support a display cross bar to create a rack for displaying retail products.

U.S. Pat. No. 4,449,686, issued to Kersey, teaches a mounting bracket for a hanger arm that is supported on a hang rod. The bracket is positioned on one end of the hanger arm and is disposed for engaging the hang rod to mount the hanger arm thereon. A pin is moveably positioned in the bracket with one end extending from the bracket towards the hang rod. The pin releasably engages the hang rod to maintain the bracket and hanger arm in position on the hang rod.

U.S. Pat. No. 4,947,431, issued to Kiggins, teaches a support member for mounting from a conventional fixed support, and for visual and tactile purposes, an item of merchandise. Variants of Kiggins include both screw mounting foot supports and "U" shaped bracket supports (for securing within inwardly recessed track or "C" channels defined along extending edges of the gondola display shelf).

U.S. Pat. No. 5,152,404, as well as U.S. Design Pat. No. 335,623, both issued to Salrin et al., disclose an angled display assembly having a plurality of product display fixtures attached to and spaced along a polygonal display standard. Each of the display fixtures includes an inverted, generally "U" shaped mounting bracket designed to slidably clamp over the display standard. A supporting arm extends outwardly from the mounting bracket and includes proximal and distal portions.

SUMMARY OF THE PRESENT INVENTION

The present invention discloses an aisle way end extender bracket for use with a vertically extending merchandising support and which extends in parallel fashion, relative to a lengthwise extending wall of the support and from beyond a vertically extending end cap support defining an extending aisle end of the back wall. In particular, the merchandise support bracket of the present invention addresses a shortcoming in the prior art in providing of an effective, safe and convenient device for supporting additional volumes of merchandise visible from an aisle end location.

An elongate extending support arm is constructed of a substantially planar and elongated shape and includes a first support end and a second extended and product display end. A foot support is secured to the first support end and is engageable with a location of the upright merchandising display proximate its vertically extending end. The foot support further includes, in some variants, a planar support surface capable of affixing, in substantially adhering fashion, against a corresponding planar extending portion of the merchandising display.

In a first variant, the lengthwise extending display wall further includes a pegboard display surface, the foot support having a first plurality of inwardly and successively upwardly angled tabs extending from an upper edge of the base surface, a second plurality of inwardly extending tabs extending from a corresponding lower edge of the base surface and engaging selected locations of the pegboard surface to mount the elongate extending arm.

In a further variant, the vertically extending end cap further includes a plurality of spaced apart slots extending in axially downward and parallel fashion relative to the lengthwise extending wall. The foot support further includes a channel defined in the planar base support surface and through which is inserted a fastener stem terminating in a single slot engagement portion. A wing nut is threadably engaging over a second extending end of the fastener stem and is tightenable to secure the bracket in place within a selected vertically extending single slot.

A yet further preferred variant discloses a pair of threaded bolts extending through associated apertures defined in the foot support end of the elongate extending arm. Rectangular shaped nuts threadably engage over the extending shaft ends of the bolts and, once the shafts are inserted within selected vertically extending slots defined in the end cap display, the nuts are tightened to secure the support arm in place.

It is also contemplated that, in any variant disclosed herein, the support arm may be axially adjustable relative to the foot support and such may be accomplished through the provision of a bracket secured to the planar foot support surface. An interior channel defined by the bracket is suitable for receiving the support arm therethrough and a rotatably tightenable screw extends within the bracket and engages the support arm at a selected axially adjusted location.

The product display end further includes an "S" hook suspended through an aperture defined within the support arm. A product support portion, such as a planar and reinforced strip or planar display, is suspended from the "S" hook and holds a plurality of individual merchandising items or signage in substantially coplanar and parallel extended and displayed fashion beyond the vertically extending end cap of the lengthwise extending wall. In this fashion, the merchandise is carried in freely swingable and safe fashion close to an adjoining edge location of the upright merchandise display.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
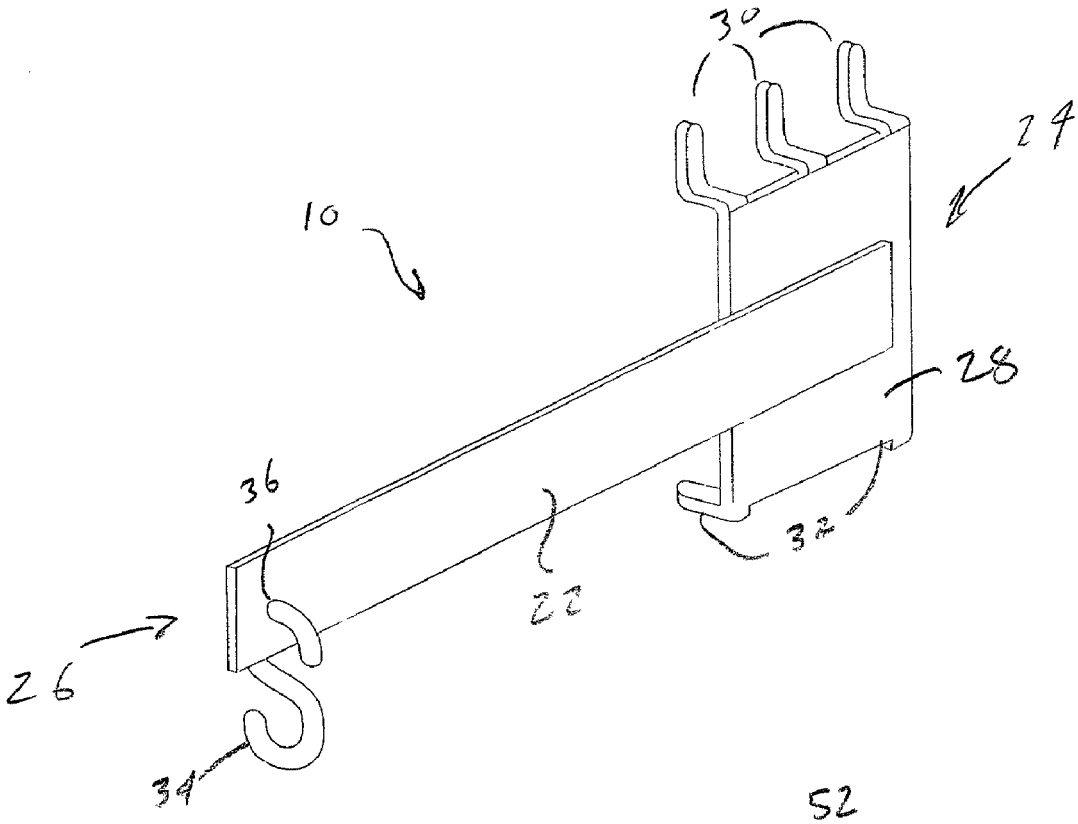
FIG. 1 is a perspective view of an aisle way end extender bracket exhibiting a pegboard foot support portion according to a first preferred variant of the present invention.
Figure 2:
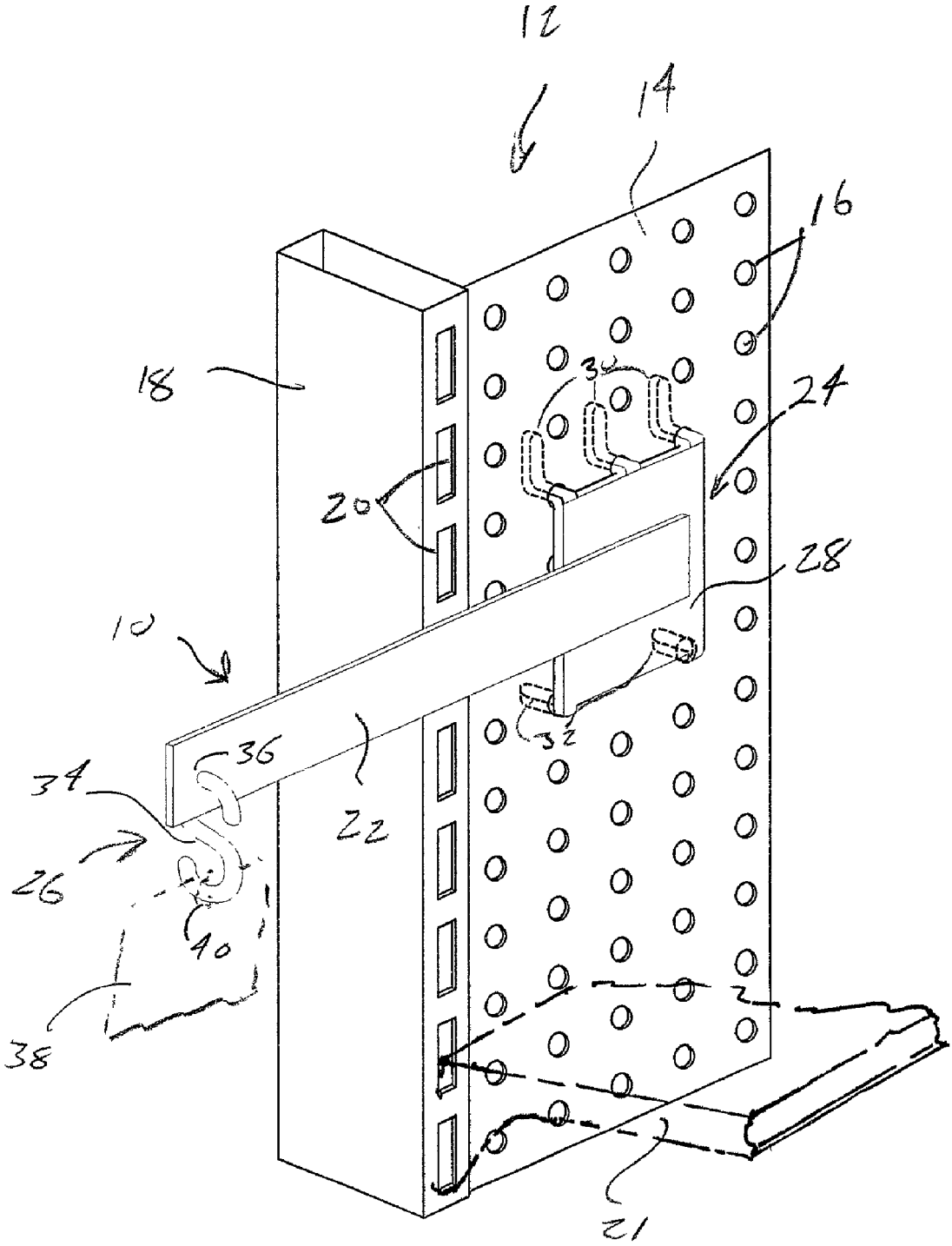
FIG. 2 is an environmental view illustrating the end extender bracket of FIG. 1 in side engaging and parallel extending fashion to a pegboard surface of an associated merchandising support back wall.

Referring now to FIGS. 1 and 2, an aisle way end extender bracket is illustrated at 10 according to a first preferred variant and for use with a vertically extending merchandising support 12 according to the present invention. As previously described, the present invention teaches an effective, safe and convenient device for supporting additional volumes of merchandise visible from an aisle end location.

Figure 4:
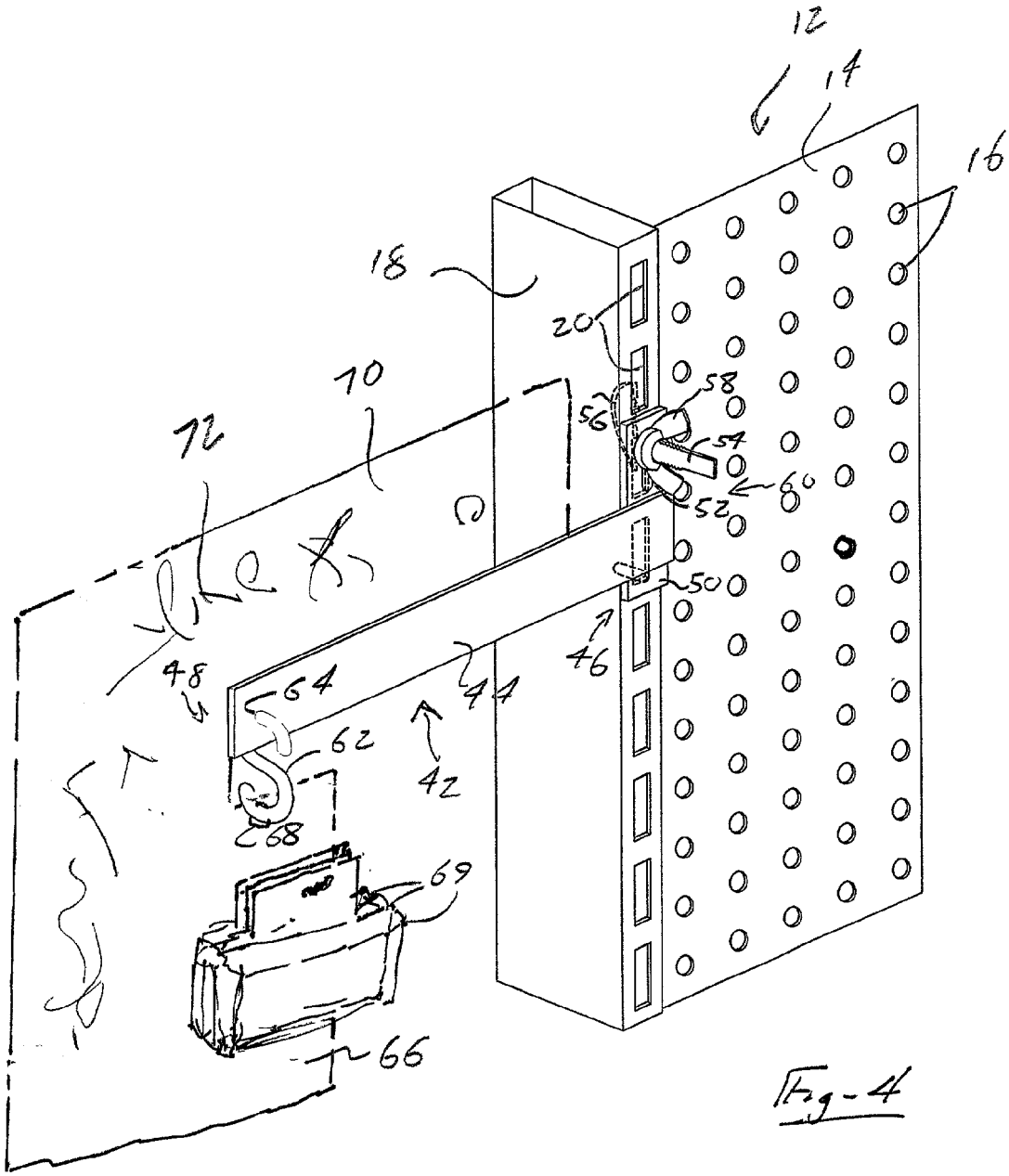
FIG. 4 is an environmental view illustrating the end extender bracket of FIG. 3 in side engaging and parallel extending fashion to a single slot back plate support defined in vertically extending fashion along the side edge of the merchandising support.

Referring particularly to the operational views of FIGS. 2 and 4, the merchandising support 12 includes a lengthwise extending and vertically disposed back wall 14, and such as may further include a plurality of pegboard apertures 16; it also being understood that the back wall 14 may exhibit a smooth exterior of other suitable display configuration. A vertically extending end cap 18 secures to a likewise extending edge of the back wall 14 and defines an aisle end location. Configured within the end cap 18 is a plurality of spaced apart and individual slots 20 extending in likewise axially downward and parallel fashion relative to the lengthwise extending wall. Although not further shown, it is understood that, in addition to the single slotted end cap 18, a double slotted arrangement could be employed and which is known within the conventional art.

While not directly relevant to the instant invention, additional conventional items, such as adjustable shelving portions, are illustrated at 21 in FIG. 2 and may adjustable along the height of the back wall 14, such as by engaging selected slots 20 in the end cap 18 at the end wall location, as well additional spaced apart and vertically extending end caps (not shown) at additional and intermediate spaced apart locations along the running length of the upright merchandise display 12.

Referring again to FIG. 1, the aisle way extender bracket 10 includes an elongate extending support arm 22, typically having a substantially planar and elongated shape such as in the form of a substantially flattened and cross wise extending bar. It is also envisioned that the arm 22, as well as the corresponding feet support portions to be subsequently described, be constructed of a durable metal or other suitable material, such as in certain applications a strong and impact resistant plasticized construction.

The elongate extending support arm 22 includes a first support end (generally referenced at 24) and a second extended and product display end (generally referenced at 26). The foot support end 24 is defined by a planar support surface 28 and, as is also illustrated in FIG. 2, includes a first plurality of inwardly and successively upwardly angled tabs 30 extending from an upper edge of the support surface 28. A second plurality of inwardly extending tabs 32 extend from a corresponding lower edge of the support surface 28 and, as illustrated in FIG. 2, engages selected pegboard apertures 16 to space the extending support arm in substantially coplanar and parallel extending fashion relative to the lengthwise extending and back wall support surface 14.

The product display end 26 is further defined by an "S" hook 34 which is suspended through an aperture 36 defined within the support arm and proximate the display end 26.

Referring again to FIG. 2, a product support portion, such as a planar and reinforced strip or planar display 38, is suspended from the "S" hook by virtue of an eyelet 40 formed through the display 38 proximate its top edge.

Although not fully disclosed in this illustration, the display 38 is understood to be constructed so as to support a plurality of individual merchandising items in substantially coplanar and parallel extended and displayed fashion beyond the vertically extending end cap of the lengthwise extending wall. Alternatively, the display 38 could be reconfigured as product signage or other display indicia and in order to increase the eye appeal of associated product, and such as may be alternately supported upon the conventional shelving portions 21. In this fashion, the merchandise is carried in freely swingable and safe fashion close to an adjoining edge location of the upright merchandise display.

Figure 3:
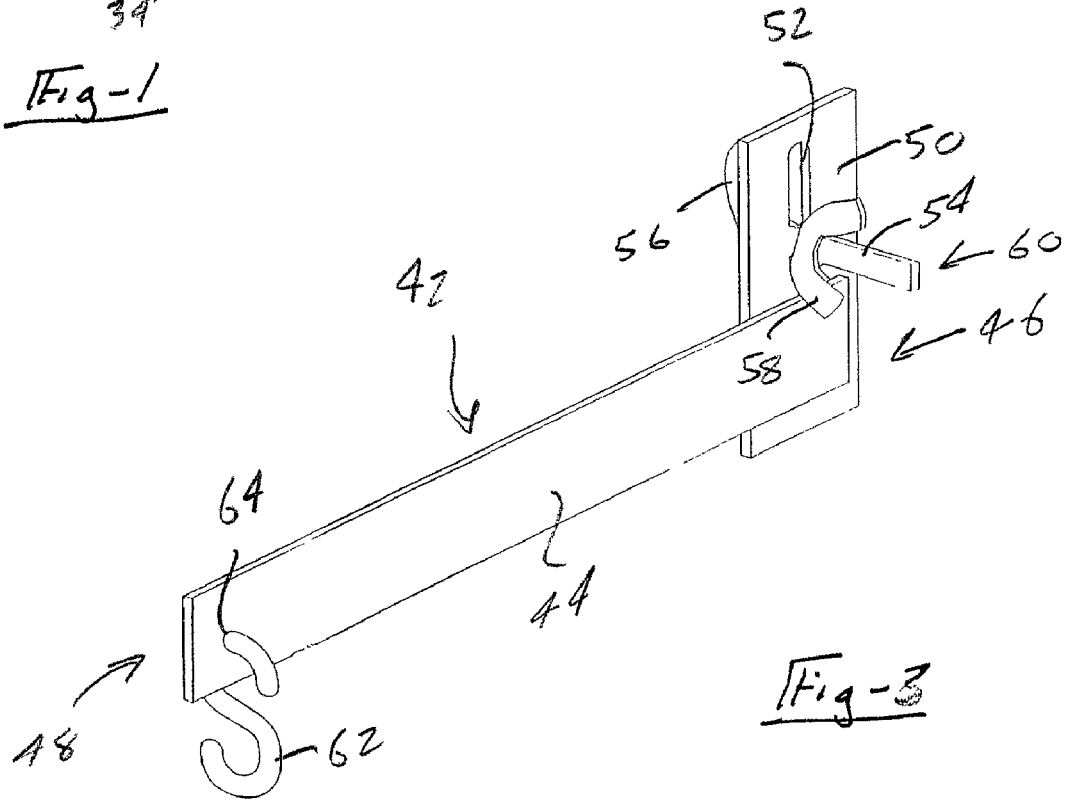
FIG. 3 is a perspective view of an aisle way end extender bracket exhibiting a single slot back plate foot support portion according to a second preferred variant of the present invention.

Referring now to FIGS. 3 and 4, an aisle way extender bracket is illustrated at 42 according to a further preferred variant of the present invention. The bracket 42 is substantially as disclosed at 10 in the variant of FIGS. 1 and 2 and includes a support arm 44 terminating in a first support end (generally referenced at 46) and a second extended and product display end (generally referenced at 48). The foot support end 46 is again defined by a planar support surface 50 and, as is also illustrated in FIG. 4, a channel 52 is defined in the planar base surface 50 and through which is inserted a fastener stem 54 terminating in a single slot engagement portion 56. A wing nut 58 is threadably engageable over a second extending end (see at 60) of the fastener stem 54 and is tightenable to secure the bracket 42 in place within a selected vertically extending single slot 20 upon the engagement portion 56 (extending beyond the reverse side of the support surface 50) seating within that associated slot 20.

The product display end 48 is further defined by an "S" hook 62 which is suspended through an aperture 64 defined within the support arm and proximate the display end 48. Referring again to FIG. 4, a product support portion, such as again including a planar and reinforced strip or planar display 66, is suspended from the "S" hook by virtue of an eyelet 68 formed through the display 66 proximate its top edge. Items of supported merchandise are further illustrated at 69 and an advertisement placard portion 70 may also be incorporated into the display 66, either integrally formed with the display 66 and/or extending from the support arm 44, such as along a top or side edge surface as best illustrated in FIG. 4. In this fashion, effective product advertisement and graphics, see at 72, may be incorporated into the bracket display and in the attempt to maximize the effectiveness of the device.

Figure 7:
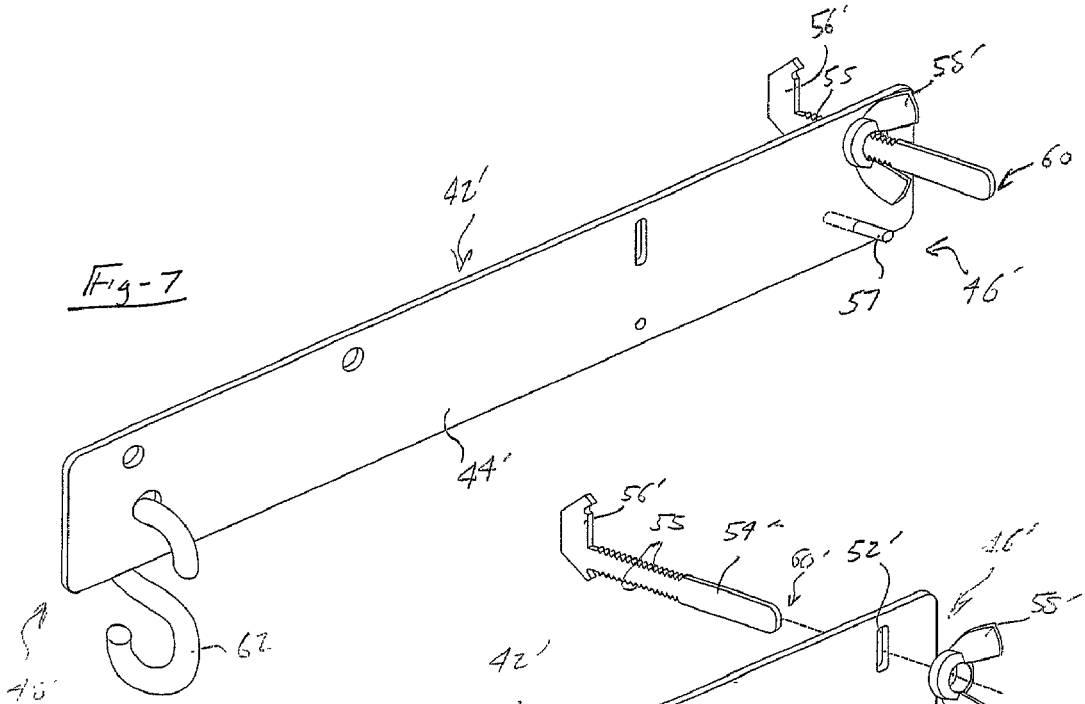
FIG. 7 is a perspective view of the end extender bracket as substantially illustrated in FIGS. 3 and 4.
Figure 8:
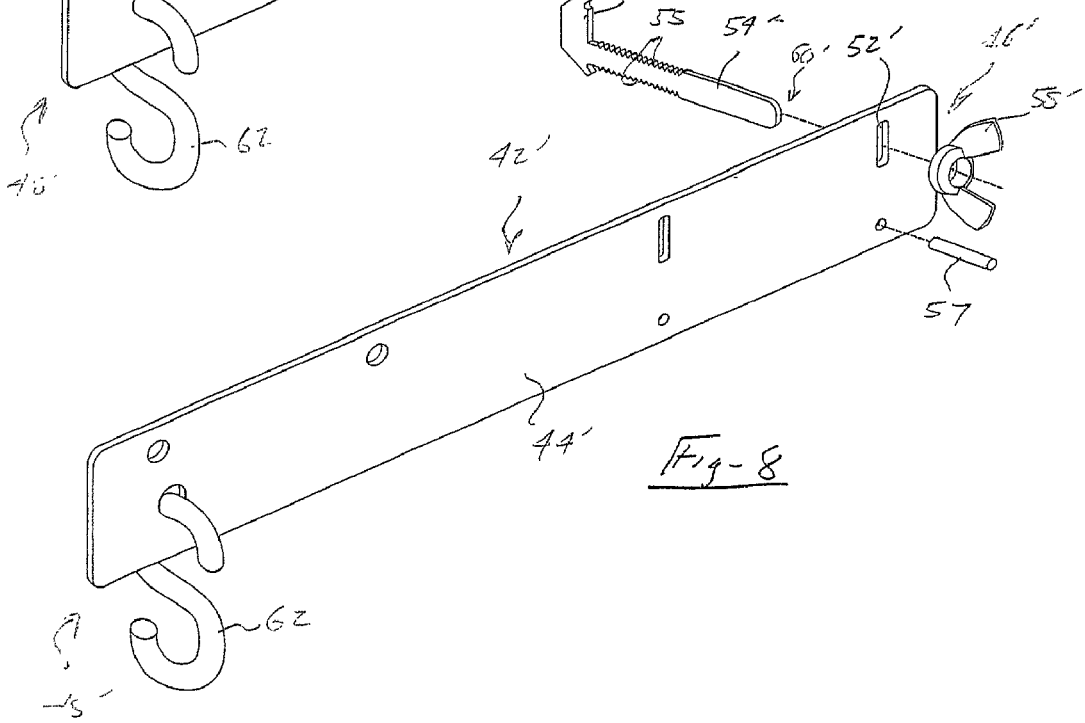
FIG. 8 is an exploded perspective of the end extender bracket of FIG. 7 and illustrating in additional detail the features of the channel defined in the support arm at its mounting/supporting end and through which is inserted the fastener stem terminating in a single slot engagement portion, the wing nut threadably engaging over a second extending end of the fastener stem and which is tightenable to secure the bracket in place within the selected and vertically extending single slot.

FIGS. 7 and 8 illustrate enlarged views of an end extender bracket 42' substantially as disclosed at 42 in the variant of FIGS. 3 and 4 and which includes support arm 44' terminating in a first support end (again generally referenced at 46') and second extended and product display end 48'. The foot support end 46', in contrast to the planar support surface 50 of the variant 42, includes a similarly configured channel 52' being defined in the planar surface of the elongate and planar extending support arm 44' itself and proximate in location to its support end 46'.

As with the substantially similar variant of the extender bracket shown at 42, a fastener stem 54' terminates in a single slot engagement portion 56'. A wing nut 58' is threadably engageable over a second extending end (see at 60') of the fastener stem 54' (once it has been inserted through a rear facing side of the channel 52' defined in the support arm 44') and is tightenable to secure the bracket 42' in place within a selected vertically extending single slot 20 upon the engagement portion 56' seating within that associated slot 20.

To facilitate the engagement of the wing nut 58' to the fastener stem 54' a plurality of axially directed serrations 55 are defined on both upper and lower corresponding edges of the substantially flattened fastener stem 54'. Additional engaging support is provided to the assembly by the addition of a peg 57 which extends from the rearward facing surface of the planar extending support arm 44', again proximate in location to its support end 46' as well as to the location of the configured channel 52'. Upon seating the fastener stem engagement portion 56' within a first selected vertical slot 20, the inwardly extending peg 57 likewise seats within a succeeding slot 20 to provide stabilizing support to the end extender bracket 42'.

Figure 5:
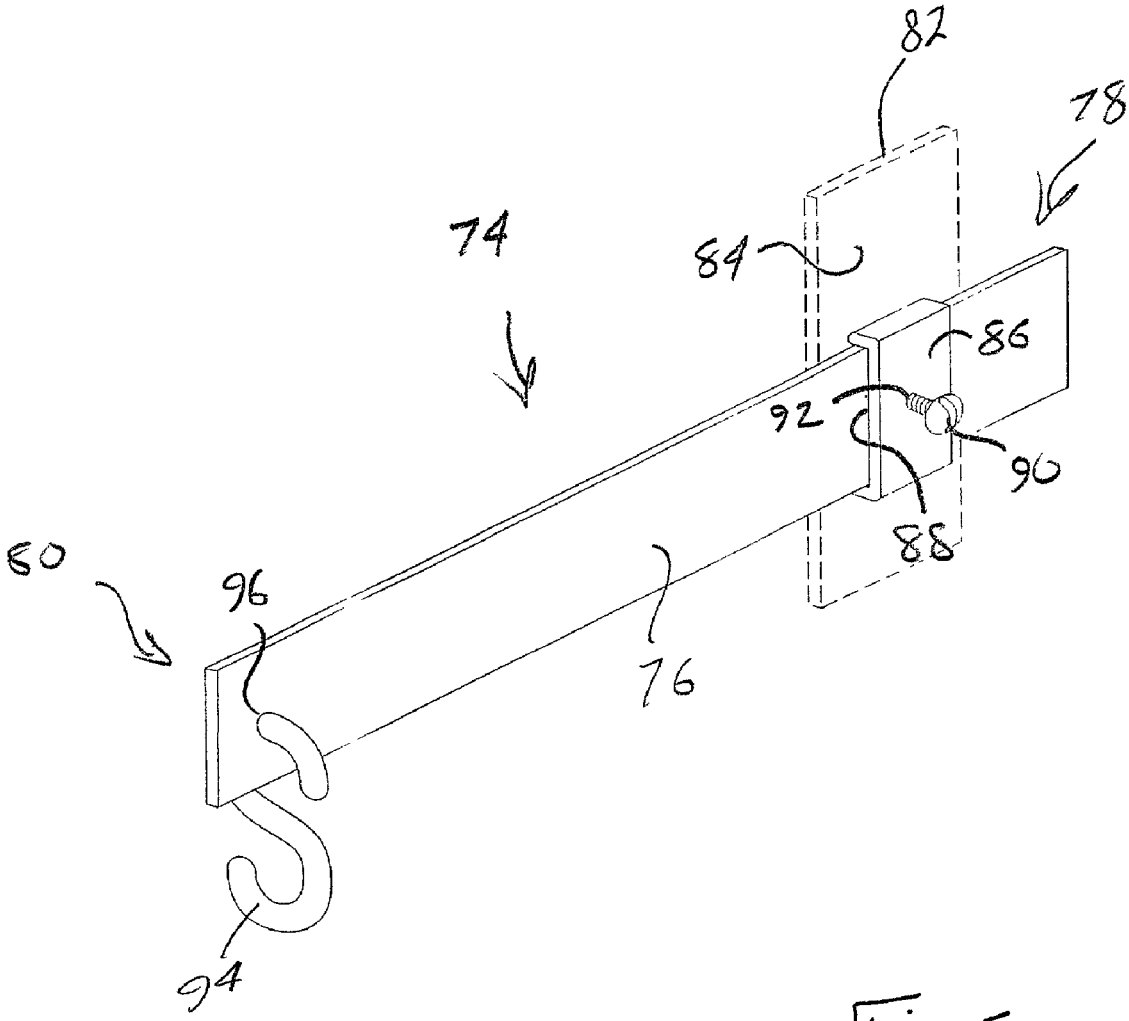
FIG. 5 is a perspective view of an aisle way end extender bracket according to a yet further preferred variant and in which the bracket support arm may be axially adjustable relative to a foot support portion thereof.

Referring now to FIG. 5, an aisle way extender bracket is illustrated at 74 according to a yet further preferred variant of the present invention and in which a bracket support arm 76 may be axially adjustable relative to a first support end 78 and opposite a second display end 80. In particular, the foot support (generically referenced at 82 at the first support end 78) further includes a planar support surface 84, upon which a bracket 86 is secured and which in turn defines an interior channel 88 of suitable dimension for receiving the support arm 76 in cross wise extending fashion therethrough. A rotatably tightenable screw 90 extends within the bracket 86, such as through an interiorly threaded aperture 92 defined therethrough, and engages the support arm 76 at a selected axially adjusted location. As with the earlier preferred variants, an "S" hook 94 extends from an associated aperture 96 defined within the display end 80 of the bracket 76, it also being understood that additional types of suspending fasteners, such as clips, rivets, clamps and the like may also be employed within the scope of the invention.

Figure 6:
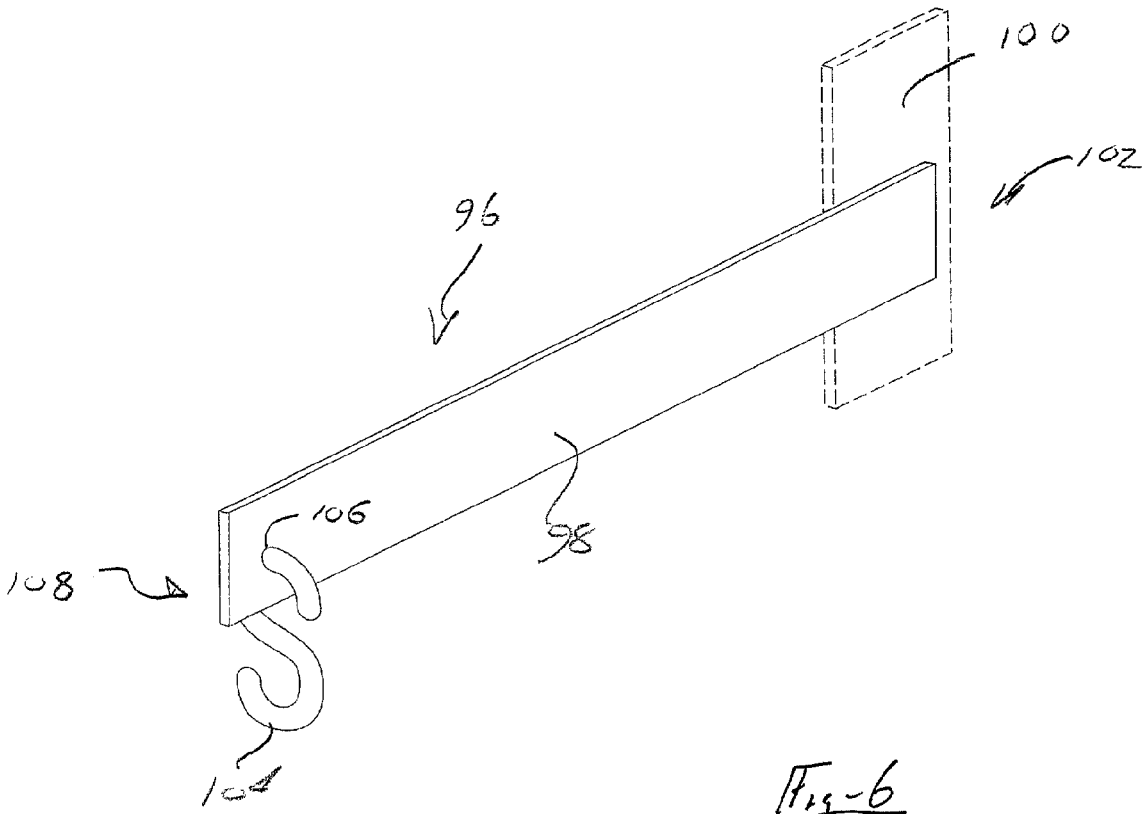
FIG. 6 is a perspective view of a further modification of the aisle way end extender bracket illustrated in FIG. 5 and showing a fixed connection between the bracket and its associated foot support portion.

Referring to FIG. 6, a fixed variant 96 is illustrated of the present invention which is largely similar to that illustrated in FIG. 5, and with the exception that support arm 98 is fixedly secured to the planar support surface 100 at the first supporting end 102. The "S" hook 104 is also again illustrated secured through an aperture 106 at the second display end 108.

Figures 9, 10:
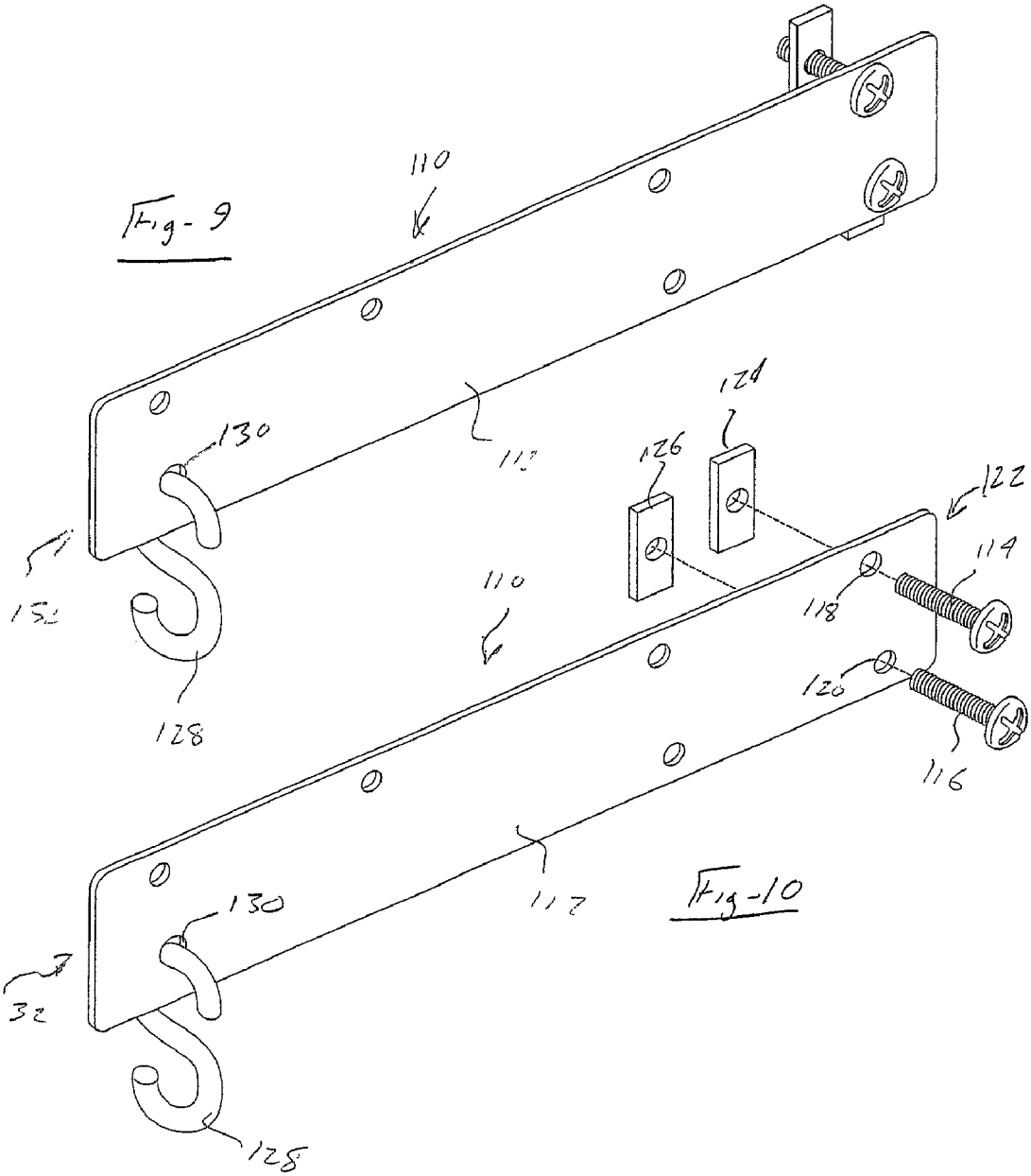
FIG. 9 is a perspective view of the end extender bracket according to a yet further preferred variant of the present invention.
FIG. 10 is an exploded perspective of the end extender bracket of FIG. 9 and illustrating in additional detail the features of the pair of threaded bolts extending through associated apertures defined in the foot support end of the elongate extending arm, as well as the rectangular shaped nuts threadably engage over the extending shaft ends of the bolts and, upon the shafts being inserted within selected vertically extending slots defined in the end cap display, being tightened to secure the support arm in place.

Finally, and referring to FIGS. 9 and 10, a yet further variant 110 is illustrated of the end extender bracket and which includes a generally elongate extending support arm 112 with a planar support surface. A pair of threaded bolts 114 and 116 extend through associated apertures 118 and 120 defined in a foot support end 122 of the elongate extending arm 112. A pair of rectangular shaped nuts 124 and 126 threadably engage over the extending shaft ends of the bolts 114 and 116 and, once the shafts are inserted within selected vertically extending slots (again at 20 as defined in the end cap display 18 illustrated in FIG. 2), the nuts 124 and 126 are tightened to secure the support arm 112 in place. As with the previously disclosed variants, an "S" hook 128 is also again illustrated secured through an aperture 130 at a second display end 132.

Having described my invention, additional preferred embodiments will become apparent to those skilled in the art to which it pertains and without deviating from the scope of the appended claims.

I claim:

1. An aisle way end extender bracket for use with an upright merchandising display, the display including a lengthwise extending wall terminating in a vertically extending end cap support, said bracket comprising:

an elongate extending support arm having a first support end and a second extended and product display end, the support arm further comprising a substantially planar and elongated shape, a foot support at said first support end, said support arm being axially adjustable relative to said foot support;

said first support end adapted to being engageable with a location of the upright merchandising display proximate the vertically extending end cap support, said support end further comprising a planar support surface capable of affixing, in substantially adhering fashion, against a corresponding planar extending portion of the merchandising display;

a further bracket securing upon said planar support surface and defining an interior channel suitable for receiving said support arm therethrough, a rotatably tightenable screw extending within said bracket and engaging said support arm at a selected axially adjusted location; and said product display end further comprising an "S" hook suspended through an aperture defined within said support arm, a product support portion adapted to being suspended from said "S" hook and holding a plurality of individual merchandising items in substantially vertically coplanar and parallel extended and displayed fashion beyond the vertically extending end cap of the lengthwise extending wall.

2. The aisle way end extender bracket as disclosed in claim 1, said elongate extending support arm having a specified shape and size and being constructed of a durable metal material.

3. An aisle way end extender bracket for use with an upright merchandising display, the display including a lengthwise extending wall terminating in a vertically extending end cap support, said bracket comprising:

an elongate and substantially horizontal extending support arm having a first support end and a second extending and display end, said elongate extending support arm further comprising a substantially planar and elongated shape;

a foot support at said first support end, said support arm being axially adjustable relative to said foot support, said first support end adapted to being engageable with a location of the upright merchandising display proximate the vertically extending end cap support;

said foot support further comprising a planar support surface, a further bracket securing upon said planar support surface and defining an interior channel suitable for receiving said support arm therethrough, a rotatably tightenable screw extending within said bracket and engaging said support arm at a selected axially adjusted location; and said support arm adapted to extend beyond the vertically extending end cap in a substantially coplanar and parallel fashion relative to the lengthwise extending wall.

4. The aisle way end extender bracket as disclosed in claim 3, a product support portion being adapted to suspend from an "S" hook suspended through an aperture defined in said support arm, and holding a plurality of individual merchandising items.

5. The aisle way end extender bracket as disclosed in claim 4, an advertisement display placard extending from said support arm.

* * * * *